US009833114B2

(12) United States Patent
Etaix et al.

(10) Patent No.: US 9,833,114 B2
(45) Date of Patent: Dec. 5, 2017

(54) DEVICE FOR FASTENING A TOILET SEAT WHICH CAN BE RAPIDLY FITTED/REMOVED

(71) Applicant: Etablissements Dubourgel Grange, Fontaine (FR)

(72) Inventors: Gérard Etaix, Fontaine (FR); David Arphant, Fontaine (FR)

(73) Assignee: Etablissements Dubourgel Grange, Fontaine (FR)

( * ) Notice: Subject to any disclaimer, the term of this patent is extended or adjusted under 35 U.S.C. 154(b) by 0 days.

(21) Appl. No.: 14/920,324

(22) Filed: Oct. 22, 2015

(65) Prior Publication Data

US 2016/0338555 A1 Nov. 24, 2016

(30) Foreign Application Priority Data

May 19, 2015 (EP) ..... 15168252

(51) Int. Cl.
*E03D 11/00* (2006.01)
*A47K 13/26* (2006.01)

(52) U.S. Cl.
CPC ..... *A47K 13/26* (2013.01); *E03D 11/00* (2013.01)

(58) Field of Classification Search
CPC ..... A47K 13/26
USPC ..... 4/420–420.5
See application file for complete search history.

(56) References Cited

U.S. PATENT DOCUMENTS 2,593,534 A * 4/1952 Campanelli ..... A47K 13/26 24/134 R
3,474,470 A * 10/1969 Watson ..... A47K 13/12 16/337
3,551,922 A * 1/1971 Watson ..... A47K 13/26 4/236
3,570,021 A * 3/1971 Watson ..... A47K 13/26 4/240
3,905,051 A * 9/1975 Gozdziewski ..... A47C 15/004 297/188.14
4,309,780 A * 1/1982 Fantetti ..... A47K 13/26 4/234
4,315,338 A * 2/1982 Harrison ..... A47K 13/12 4/236
4,326,307 A * 4/1982 Baillie ..... A47K 13/26 16/252
4,962,551 A * 10/1990 Bly ..... A47K 11/04 16/DIG. 13

(Continued)

FOREIGN PATENT DOCUMENTS

CN 201861549 U 6/2011
CN 202636818 U 1/2013

OTHER PUBLICATIONS

Preliminary Search Report filed in EP 15168252 dated Aug. 26, 2015; 2 pages.

*Primary Examiner* — Lori Baker
(74) *Attorney, Agent, or Firm* — Michael Best & Friedrich LLP

(57) ABSTRACT

A device for fastening a toilet seat to at least one first element of a toilet bowl, including a first locking part and wherein, for each back and forth motion of the fastening device relative to the bowl, the locking part is capable of alternately displacing between a first position where the first locking part cooperates with the first element and a second position where the fastening device may be separated from the first element.

16 Claims, 6 Drawing Sheets

(56) References Cited

U.S. PATENT DOCUMENTS 5,414,875 A * 5/1995 Kappl ..... A47K 13/26 4/236
5,638,554 A * 6/1997 Corzine ..... A47K 13/26 4/236
5,852,831 A * 12/1998 Naughton ..... A47K 13/12 2/236
5,875,499 A * 3/1999 Hoffman ..... E03D 5/08 4/249
5,933,875 A * 8/1999 Hulsebus ..... A47K 13/12 4/240
6,381,762 B1 * 5/2002 Moser ..... A47K 13/12 16/252
6,418,566 B1 * 7/2002 Plonta ..... A47K 13/10 4/237
7,203,975 B2 * 4/2007 Vierkant, III ..... A47K 13/26 4/236
7,389,549 B2 * 6/2008 Vierkant, III ..... A47K 13/12 4/236
7,712,157 B2 * 5/2010 Laundre ..... A47K 13/26 4/236
8,024,821 B2 * 9/2011 Chen ..... A47K 13/26 4/236
8,087,103 B2 * 1/2012 Leibfried ..... A47K 13/26 4/234
8,327,471 B2 * 12/2012 Fielding, Jr. ..... A47K 13/26 4/236
8,763,169 B2 * 7/2014 Daniels ..... A47K 13/005 4/239
2005/0217008 A1 * 10/2005 Vierkant, III ..... A47K 13/26 4/240
2005/0217009 A1 * 10/2005 Vierkant, III ..... A47K 13/26 4/240
2007/0294813 A1 * 12/2007 Leibfried ..... A47K 13/26 4/240
2008/0034483 A1 * 2/2008 Schanz ..... A47K 13/04 4/240
2010/0125935 A1 * 5/2010 Leibfried ..... A47K 13/26 4/240
2011/0173743 A1 * 7/2011 Jensen ..... E03D 1/26 4/420
2012/0011646 A1 * 1/2012 Dundas ..... A47K 13/12 4/420
2012/0284909 A1 11/2012 Chen
2013/0198942 A1 * 8/2013 Leibfried ..... A47K 13/26 4/240
2013/0269092 A1 * 10/2013 Hand ..... A47K 13/26 4/240
2013/0340154 A1 * 12/2013 Hand ..... F16B 13/128 4/240
2014/0150172 A1 * 6/2014 Clark ..... A47K 13/26 4/240
2014/0215700 A1 * 8/2014 Jensen ..... A47K 13/26 4/236
2015/0216380 A1 * 8/2015 Timothy ..... A47K 13/26 4/240

* cited by examiner

DEVICE FOR FASTENING A TOILET SEAT WHICH CAN BE RAPIDLY FITTED/REMOVED

BACKGROUND

The present disclosure relates to a device for fastening a toilet seat.

DISCUSSION OF THE RELATED ART

A toilet seat generally comprises a seat and a lid which are hingedly assembled on a bowl. The back portion of the toilet seat may be fastened to the bowl by bolts having their nuts generally located under the seating portion. A disadvantage is that the fitting and the removal of the toilet seat, particularly for the maintenance thereof, requires unscrewing and screwing the bolts, which may be uneasily accessible, the bowl being generally placed in a narrow room. Another disadvantage is that the fitting and the removal of the toilet seat for maintenance requires manipulating the bolt and the back portion of the toilet seat, which may be relatively uncleaned parts due to their location.

There exist toilet seats where the seat and the lid of the toilet seat are pivotally mounted on a fastening device which is fastened on two pins attached to the toilet bowl by a locking device which may be released by pressing on a button located at the back or at the front of the toilet seat. A disadvantage is that the fitting and the removal of the toilet seat for the maintenance thereof generally requires manipulating the back portion of the toilet seat. According to a variation, a protrusion may be provided at the back of the seat to press on the unlock button when the seat is up. A disadvantage then is that the unlock button is actuated each time the seat is put up, which may cause an incidental unwanted removal of the toilet seat.

There exist toilet seats where the toilet seat comprises, at its back portion, a magnet which cooperates with a magnet provided on the bowl to fasten the toilet seat to the bowl. A disadvantage is that, to provide a good fastening of the toilet seat to the bowl, the attractive force of the magnets used should be relatively significant, whereby removing the toilet seat may require applying a significant force.

It would be desirable to be able to simply fit and/or remove a toilet seat, particularly for the maintenance thereof, with no excessive effort and without having to manipulate the back portion of the toilet seat.

SUMMARY

An object of an embodiment aims at overcoming all or part of the disadvantages of previously-described toilet seat fastening devices.

Another object of an embodiment is for the toilet seat to be able to be fitted or removed, particularly for the maintenance thereof, with no manipulation of the back portion of the toilet seat.

Another object of an embodiment is for the user to be able to simply and rapidly fit and remove the toilet seat, particularly for the maintenance thereof.

Another object of an embodiment is for the toilet seat to be able to be fitted or removed, particularly for the maintenance thereof, with no excessive effort.

Thus, an embodiment provides a device for fastening a toilet seat to at least one first elements fastened to a toilet bowl, comprising a first locking part and wherein, for each back and forth motion of the fastening device relative to the bowl, the locking part is capable of alternately displacing between a first position where the first locking part cooperates with the first element and a second position where the fastening device can be separated from the first element.

According to an embodiment, the device comprises a support, a first arm hinged with respect to the support and stressed at a first end by a spring and intended to be stressed by the first element at a second end, the first arm cooperating with a first cam hinged with respect to the support and capable of allowing the pivoting of the first hinged locking part relative to the support, for each back and forth motion of the fastening device relative to the bowl, alternately between a first position where the first locking part partly penetrates into a first groove of the first element and a second position where the first locking part does not penetrate into the first groove.

According to an embodiment, the first arm is hinged with respect to the support around a first axis and the first cam and the first locking part are hinged with respect to the support around a second axis different from the first axis.

According to an embodiment, the first cam comprises a first groove following a closed curve.

According to an embodiment, the device comprises a first finger attached to the first arm and penetrating into the first groove.

According to an embodiment, the second axis is outside of the first curve.

According to an embodiment, the first locking part comprises first stressing means capable of having the first locking part pivot against the first element.

According to an embodiment, the first stressing means comprise a first flexible tab.

According to an embodiment, the device comprises a second arm hinged with respect to the support and stressed at a third end by the spring and intended to be stressed by a second element of the bowl at a fourth end, the second arm cooperating with a second cam hinged with respect to the support and capable of allowing the pivoting of a second locking part hinged with respect to the support, for each back and forth motion of the fastening device relative to the bowl, alternately between a third position where the second locking part partly penetrates into a second groove of the second element and a fourth position where the second locking part does not penetrate into the second groove.

According to an embodiment, the first arm comprises a first toothed portion and the second arm comprises a second toothed portion, the first toothed portion meshing with the second toothed portion.

According to an embodiment, the second arm is hinged with respect to the support around a third axis and the second cam and the second locking part are hinged with respect to the support around a fourth axis different from the third axis.

According to an embodiment, the second cam comprises a second groove following a second closed curve.

According to an embodiment, the device comprises a second finger fastened to the second arm and penetrating into the second groove.

According to an embodiment, the fourth axis is outside of the second curve.

According to an embodiment, the second locking part comprises second stressing means capable of pivoting the second locking part against the second element.

An embodiment also provides a toilet comprising a bowl and a toilet seat, and a device, such as previously defined, for fastening the toilet seat to at least one first element fastened to the bowl.

BRIEF DESCRIPTION OF THE DRAWINGS

The foregoing and other features and advantages will be discussed in detail in the following non-limiting description of specific embodiments in connection with the accompanying drawings, among which.

DETAILED DESCRIPTION

Figure 1:
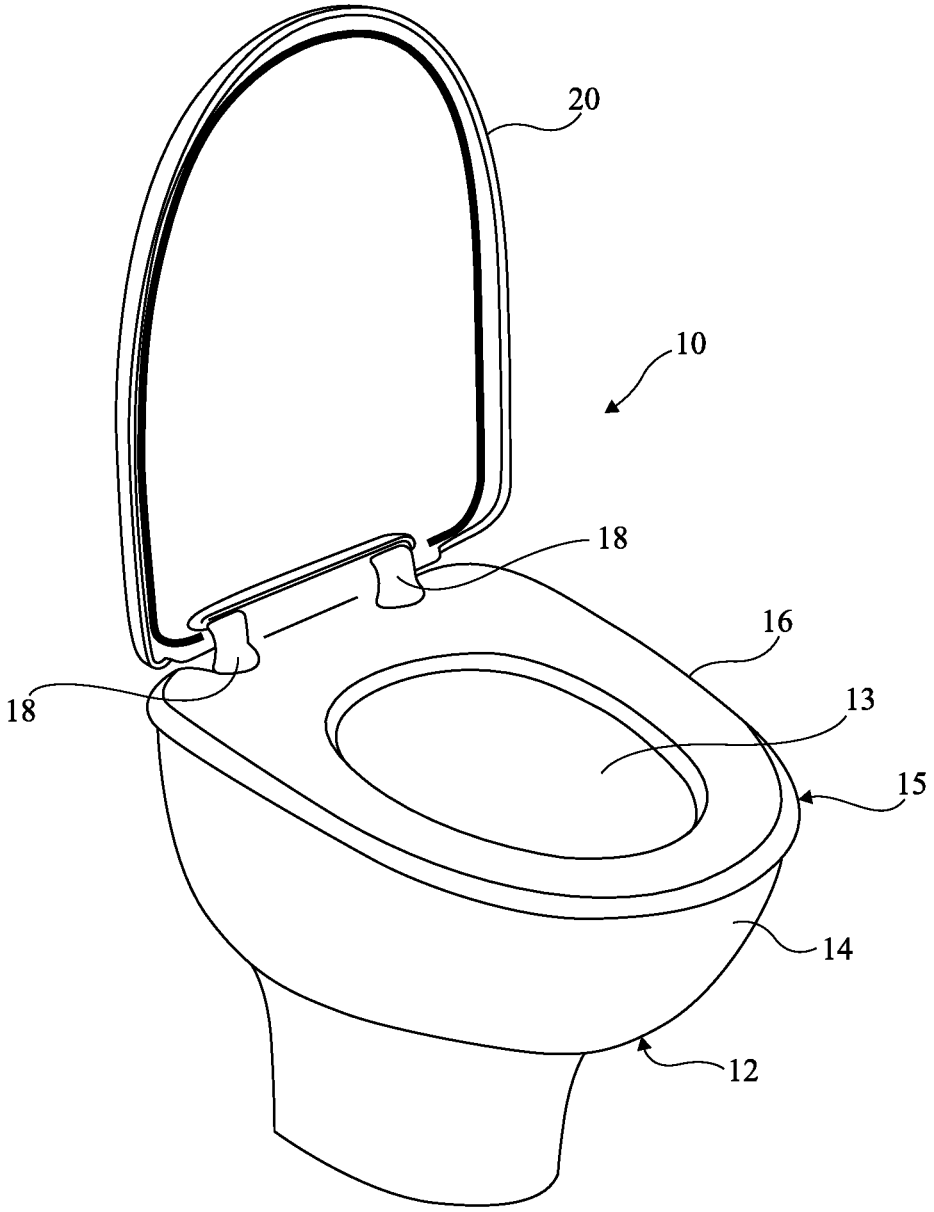
FIG. 1 is a perspective view of an embodiment of a toilet.

For clarity, the same elements have been designated with the same reference numerals in the various drawings and, further, the various drawings are not to scale. In the following description, expressions "substantially", "around", and "approximately" mean "to within 10%". Further, adjectives "front", "back", "lower" and "upper" are used with respect to the usual orientation of a toilet.

FIG. 1 shows an embodiment of a toilet 10 comprising a bowl 12 having an internal cavity 13 and an edge forming a seating portion 14. A toilet seat 15 is fastened to bowl 12. Toilet seat 15 comprises a seat 16, for example, made of a plastic material, pivotally assembled with respect to bowl 12 at the level of a fastening device 18 fastened to the back portion of bowl 12 so that seat 16 covers seating portion 14 when it is put down on bowl 12. A lid 20, for example, made of a plastic material, is also pivotally assembled with respect to fastening device 18 so that lid 20 covers seat 16 when it is put down on bowl 12. When seat 16 and lid 20 are put down on bowl 12, they close internal cavity 13 of bowl 12.

Figure 2:
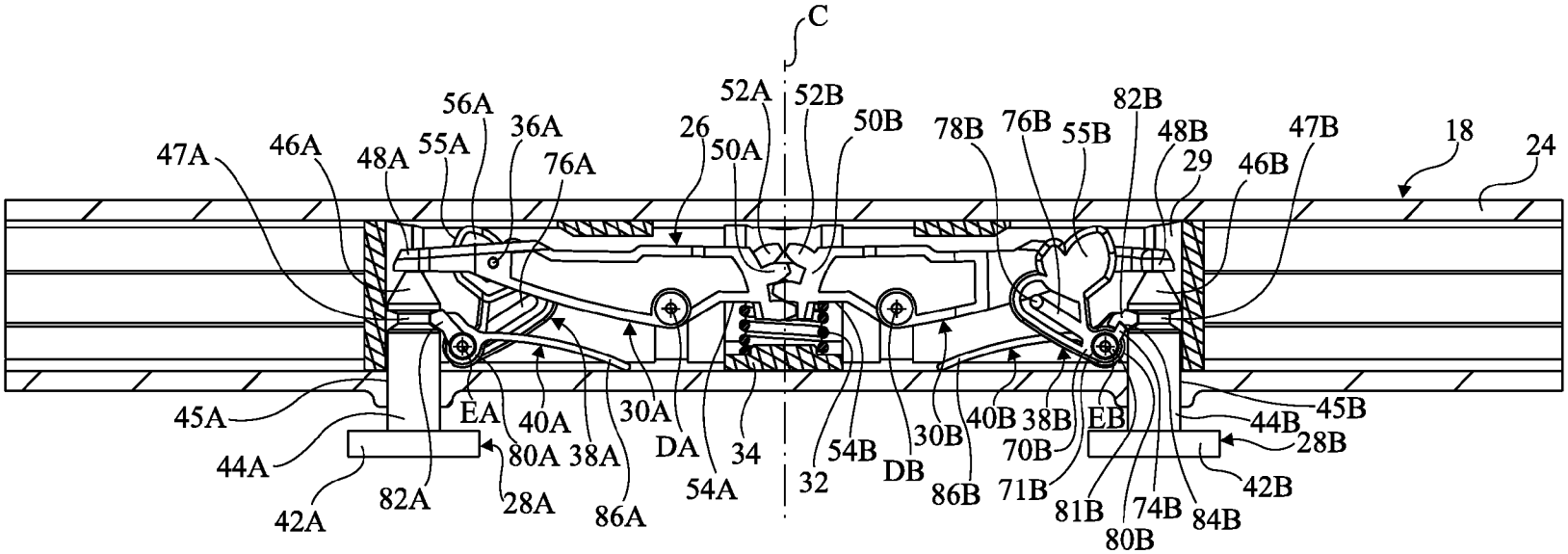
FIG. 2 is a cross-section view of an embodiment of a device for fastening a toilet seat to a toilet bowl.

FIG. 2 is a cross-section view of an embodiment of fastening device 18 in closed position. The cross-section plane is a vertical plane perpendicular to the horizontal direction oriented from front to back of toilet 10. In FIG. 2, seat 16 and lid 20 are not shown.

Fastening device 18 comprises a cylindrical tube 24 containing a locking device 26 having an axial symmetry relative to a vertical axis C. In the following description, the elements which are symmetrical with respect to axis C are designated with the same reference numeral followed by letter "A" when the element is totally or mainly located to the left of axis C in FIG. 2, and followed by letter "B" when the element is totally or mainly located to the right of axis C in FIG. 2.

Fastening device 18 is fastened to two elements 28A, 28B, for example, pins, attached to the bowl, not shown. The spacing between pins 28A and 28B is for example in the range from 10 cm to 25 cm. The diameter of tube 24 is a few centimeters, for example, from 2 cm to 3 cm. Locking device 26 comprises a support 29 fastened to the internal wall of tube 24. Locking device 26 further comprises two arms 30A, 30B. Each arm 30A, 30B is mounted so as to pivot with respect to support 29 around an axis DA, DB, which is for example horizontal. Arms 30A, 30B are stressed by a spring 32, for example, a helical spring, having one end maintained on a base 34 forming part of support 29. A finger is fastened to each arm 30A, 30B, only finger 36A being shown in FIG. 2. Each finger 36A cooperates with a cam 38A, 38B mounted so as to pivot with respect to support 29 around an axis EA, EB, which is, for example, horizontal. Each cam 38A, 38B may pivot a locking part 40A, 40B, mounted so as to pivot with respect to support 29 around axis EA, EB.

Figure 3:
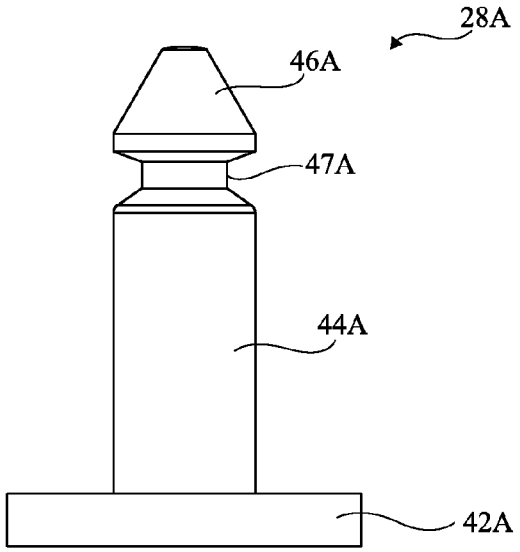
FIGS. 3 and 4 are front views of parts of the embodiment of the fastening device of FIG. 2.

FIG. 3 shows pin 28A. Each pin 28A, 28B comprises a base 42A, 42B resting on the bowl, a cylindrical body 44A, 44B extending along an axis parallel to axis C from base 42A, 42B and extending in a tapered end portion 46A, 46B. In locked position, each cylindrical body 44A, 44B penetrates into an opening 45A, 45B provided in tube 24. A groove 47A, 47B is made in cylindrical body 44A, 44B at the junction between cylindrical body 44A, 44B and end portion 46A, 46B.

Figure 4:
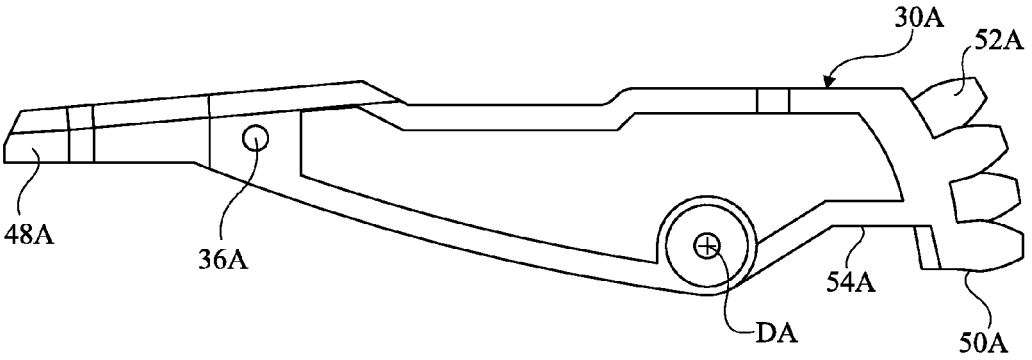

FIG. 4 shows arm 30A. Each arm 30A, 30B comprises an end 48A, 48B capable of bearing against end portion 46A, 46B of pin 28A, 28B when fastening device 18 is in locked position. Each arm 30A, 30B comprises a toothed wheel sector 50A, 50B at the end opposite with respect to axis DA to end 48A, 48B comprising teeth 52A, 52B on two rows. Toothed wheel sector 50A of arm 30A permanently meshes with toothed wheel sector 50B or arm 30B, so that arms 30A, 30B simultaneously pivot around axes DA, DB, the clockwise or counterclockwise pivoting direction of arm 30A being opposite to the pivoting direction of arm 30B and the inclination angles of arms 30A, 30B permanently being, in absolute value, substantially identical. Each arm 30A, 30B comprises a portion 54A, 54B having one end of spring 32 pressing against it. Finger 36A is fastened to arm 30A, 30B between axis DA, DB and end 48A, 48B.

Figure 5A:
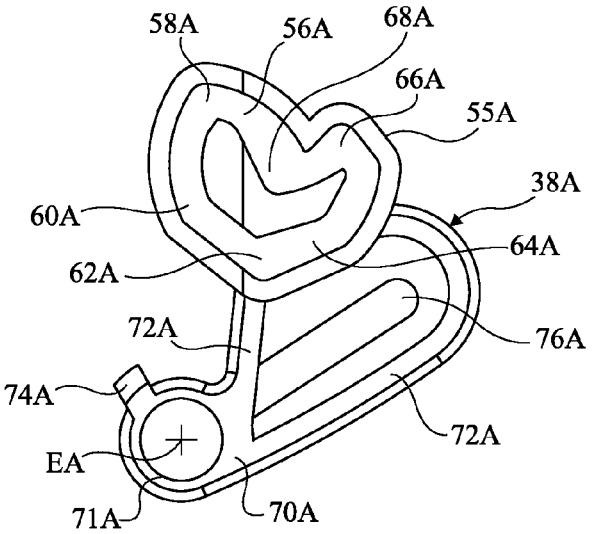
FIGS. 5A and 5B are front views of each side of another part of the embodiment of the fastening device of FIG. 2.
Figure 5B:
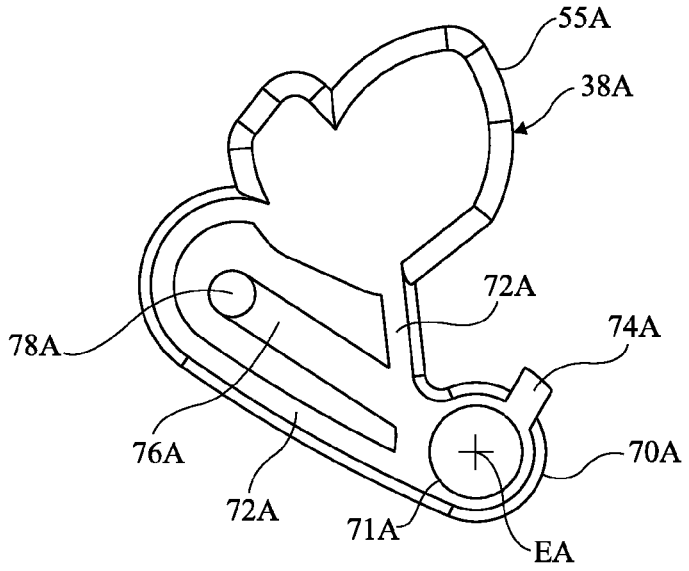

FIGS. 5A and 5B show the two sides of cam 38A. Each cam 38A, 38B comprises a guiding portion 55A, 55B comprising a groove 56A having a finger 36A capable of moving therein, only groove 56A of cam 38A being visible in the drawings. Groove 56A follows a closed curve which successively comprises, in FIG. 5A in the counterclockwise direction, a first limiting upper position 58A, a limiting outer position 60A, a limiting lower position 62A, a limiting inner position 64A, a second limiting upper position 66A, and a locking position 68A. Guiding portion 55A, 55B is connected to a portion forming a pivot 70A, 70B by two connection portions 72A, 72B. Pivot-forming portion 70A, 70B comprises a cylindrical opening 71A, 71B of axis EA, EB. Rotation axis EA, EB of each cam 38A, 38B is located outside of groove 56A. Pivot-forming portion 70A, 70B comprises a pin 74A, 74B. Each cam 38A, 38B comprises a flexible tab 76A, 76B for example extending from pivot-forming portion 70A, 70B and ending in a convex portion 78A, 78B which rubs against support 28 when cam 38A, 38B pivots around axis EA, EB.

Figure 6A:
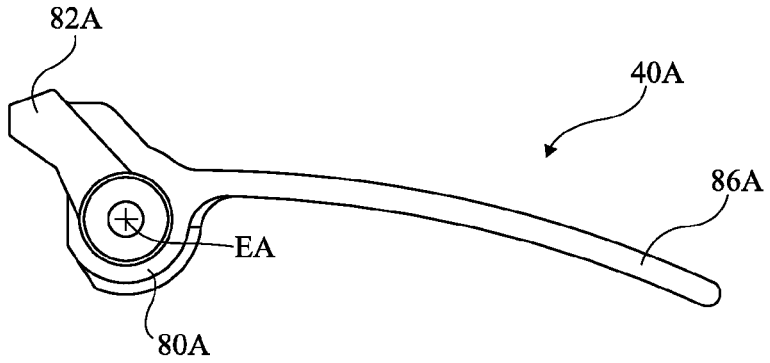
FIGS. 6A and 6B are front views of each side of another part of the embodiment of the fastening device of FIG. 2.
Figure 6B:
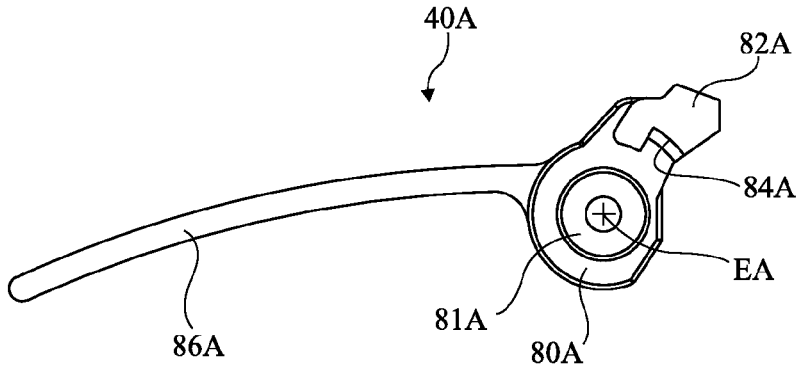

FIGS. 6A and 6B show the two sides of locking part 40A. Each locking part 40A, 40B comprises a pivot-forming portion 80A, 80B pivotally assembled with respect to support 29 around axis EA, EB. Pivot-forming portion 80A, 80B comprises a cylindrical portion 81A, 81B having cylindrical opening 71A, 71B of each associated cam 38A, 38B assembled thereto. Pivot-forming portion 80A, 80B extends in a head 82A, 82B. A recess 84A, 84B forming a stop is provided on one of the sides of head 82A, 82B. A flexible tab 86A, 86B extends from pivot-forming portion 80A, 80B.

Arms 30A, 30B and cams 38A, 38B may be made of polyamide. Fingers 36A may be made of stainless steel. Locking parts 40A, 40B may be made of polyacetal.

FIG. 2 shows fastening device 18 in a locked position. In this position, finger 36A maintained by each arm 30A, 30B is in the locking position 68A of groove 56A. Locking part 40A, 40B is maintained under the action of flexible tab 86A, 86B against pin 28A, 28B, head 82A, 82B of locking part 40A, 40B penetrating into notch 47A, 47B of pin 28A, 28B.

FIGS. 7A to 7E are views similar to FIG. 2 of the embodiment of locking device 18 at successive steps during a toilet seat removal operation. Only the rotating motions of arm 30A, of cam 38A, and of locking part 40A are described, the rotating motions of arm 30B, of cam 38B, and of locking part 40B being symmetrical with respect to axis C. Head 82A, 82B and groove 47A, 47B of pin 28A, 28B are shaped so that, while head 82A, 82B penetrates into groove 47A, 47B of pin 28A, 28B, head 82A, 82B remains locked in groove 47A, 47B in the case where tube 24 is removed from the bowl. Locking device 18 thus remains locked on pins 28A, 28B when only a traction is exerted on the toilet seat in vertical position.

Figure 7A:
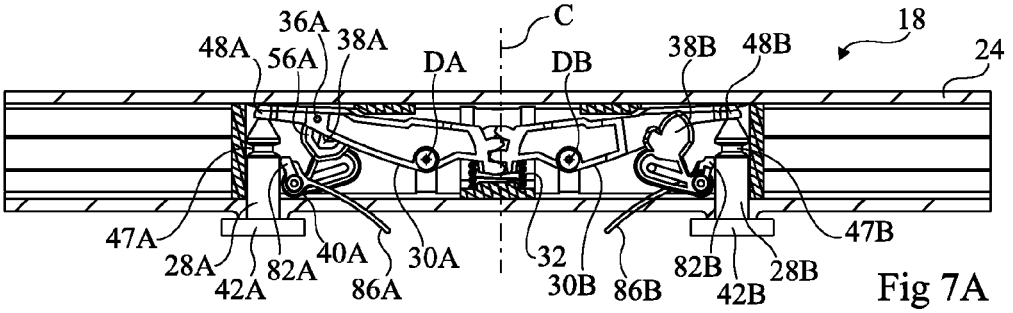
FIGS. 7A to 7E are cross-section views of the embodiment of the fastening device of FIG. 2 at successive steps during an operation of removing the toilet seat from a toilet bowl.

FIG. 7A shows locking device 18 after a user has, with respect to the locked position shown in FIG. 2, displaced tube 24 with respect to the seating portion downwards along direction C, tube 24 substantially coming into contact with bases 42A, 42B of pins 28A, 28B. This may be obtained by putting up the seat and the lid vertically and by exerting a pressure on the front portion of the seat and of the lid downwards along direction C. Head 82A and groove 47A of pin 28A are shaped so that, when head 82A penetrates into groove 47A of pin 28A, the efforts exerted by pin 28A on head 82A, when tube 24 is brought closer to the seating portion, cause the clockwise pivoting of locking part 40A around axis EA in FIG. 7A until head 82A comes out of groove 72A. Once head 82A has come out of groove 47A, it keeps on sliding along cylindrical body 44A of pin 28A. Moreover, when tube 24 is brought closer to the seating portion, pins 28A, 28B exert a pressure on ends 48A, 48B of arms 30A, 30B. This causes a pivoting of arms 30A, 30B around axes DA and DB and compressing of spring 32. Arm 30A pivots clockwise in FIG. 7A. Finger 36A displaces in groove 56A of cam 38A, 38B from locking position 68A to the first limiting upper position 58A. This translates in FIG. 7A by a clockwise pivoting of cam 38A around axis EA. The pivoting of locking part 40A causes the deformation of flexible tab 86A against tube 24. For simplification, in FIGS. 7A, 7B, and 7C, deformed flexible tabs 86A, 86B are shown as crossing tube 24.

As a variation, the removal of head 82A from groove 47A may be obtained by the pivoting of cam 38A, which may cause a clockwise pivoting of locking part 40A around axis EA in FIG. 7A to disengage head 82A from groove 47A, by the pressing of pin 74A against stop 84A of locking part 40A.

Figure 7B:
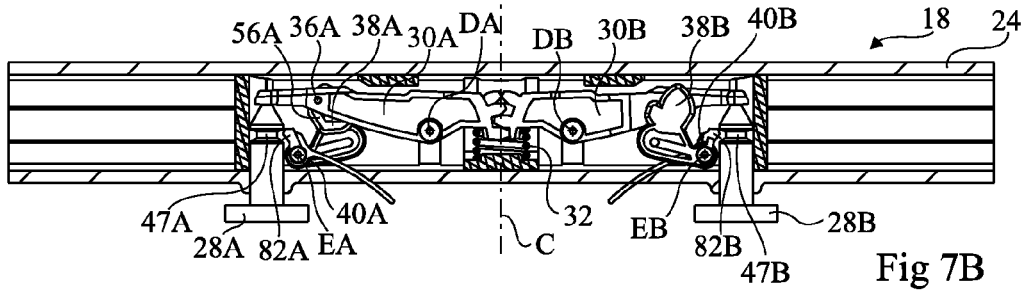

FIG. 7B shows locking device 18 after the user has, with respect to the position shown in FIG. 7A, started taking tube 24 away from the seating portion by displacing it upwards along direction C. This may be obtained by exerting a traction on the front part of the seat and of the lid, in vertical position, upwards along direction C. As a variation, the action of spring 32 may be such that the user does not have to or only slightly has to pull on the toilet seat. Under the action of spring 32, arm 30A has pivoted around axis DA in the counterclockwise direction in FIG. 7B. Finger 36A displaces in groove 56A of cam 38A from limiting upper position 58A to a position closer to limiting outer position 60A. Groove 56A substantially follows, between limiting upper position 58A and limiting outer position 60A, an arc of a circle of axis DA. This translates in FIG. 7B as a maintaining substantially in angular position of cam 38A around axis EA and also of locking part 40A under the action of pin 74A of cam 38A bearing against stop 84A of locking part 40A. Head 82A of locking part 40A thus does not penetrate into groove 47A of pin 28A when, due to the relative displacement between pin 28A and locking part 40A, head 82A is located opposite groove 47A as shown in FIG. 7B.

Figure 7C:
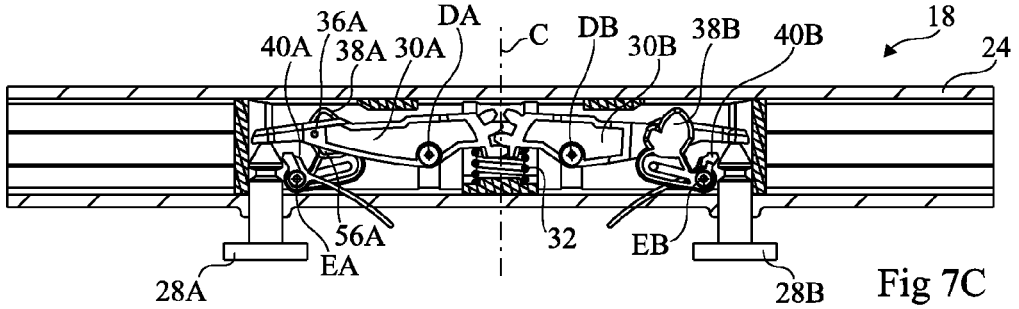

FIG. 7C shows locking device 18 after the user has, with respect to the position shown in FIG. 7B, continued taking tube 24 away from the seating portion by displacing it upwards along direction C. Under the action of spring 32, arm 30A has pivoted around axis DA in the counterclockwise direction in FIG. 7C. Finger 36A displaces in groove 56A of cam 38A all the way to limiting outer position 60A. This translates in FIG. 7C as a maintaining substantially in angular position of cam 38A and also of locking part 40A under the action of pin 74A of cam 38A bearing against stop 84A of locking part 40A.

Figure 7D:
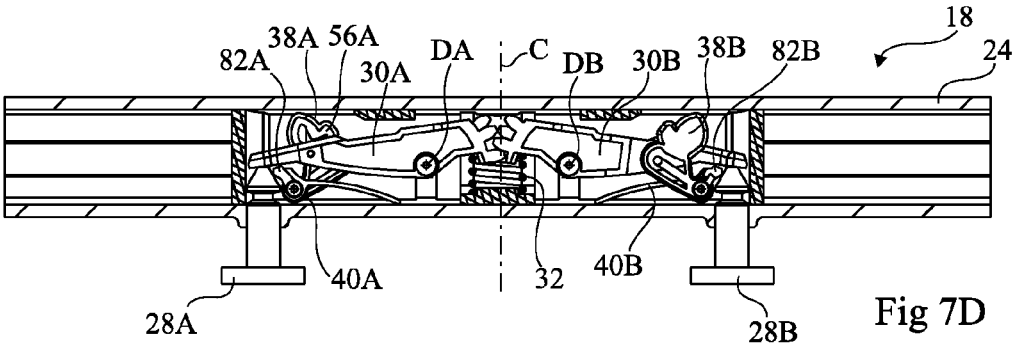

FIG. 7D shows locking device 18 after the user has, with respect to the position shown in FIG. 7C, continued taking tube 24 away from the seating portion by displacing it upwards along direction C. Under the action of spring 32, arm 30A has pivoted around axis DA in the counterclockwise direction in FIG. 7D. Finger 36A displaces in groove 56A of cam 38A all the way to limiting lower position 62A. This translates in FIG. 7D by a counterclockwise pivoting of cam 38A around axis EA. Under the action of flexible tab 86A, a counterclockwise pivoting of locking part 40A around axis EA maintaining it stopped against pin 74A of cam 38A is obtained. Head 82A, 82B being located at the level of end portion 46A, 46B of pin 28A, head 82A, 82B does not oppose the displacement of pin 28A.

Figure 7E:
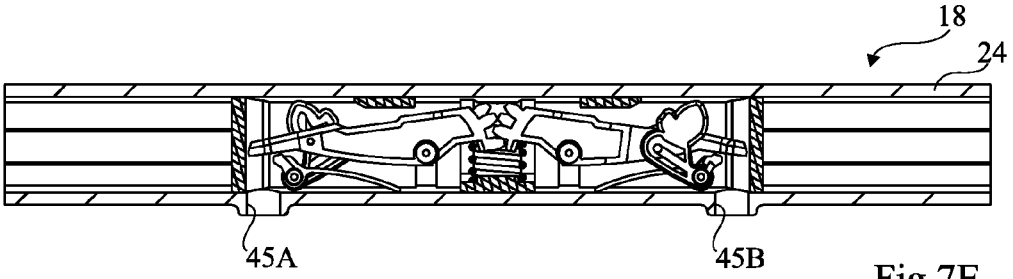

FIG. 7E shows locking device 18 after the user has, with respect to the position shown in FIG. 7D, kept on taking tube 24 away from the seating portion by displacing it upwards along direction C. Pins 28A, 28B have been totally removed from tube 24. The toilet seat is then no longer fastened to the seating portion.

FIGS. 8A to 8D are views similar to FIG. 2 of the embodiment of locking device 18 at successive steps during a toilet seat fitting operation. Only the rotating motions of arm 30A, of cam 38A, and of locking part 40A are described, the rotating motions of arm 30B, of cam 38B, and of locking part 40B being symmetrical with respect to axis C.

When the toilet seat is not connected to the seating portion, fastening device 18 is in the configuration shown in FIG. 7E.

Figure 8A:
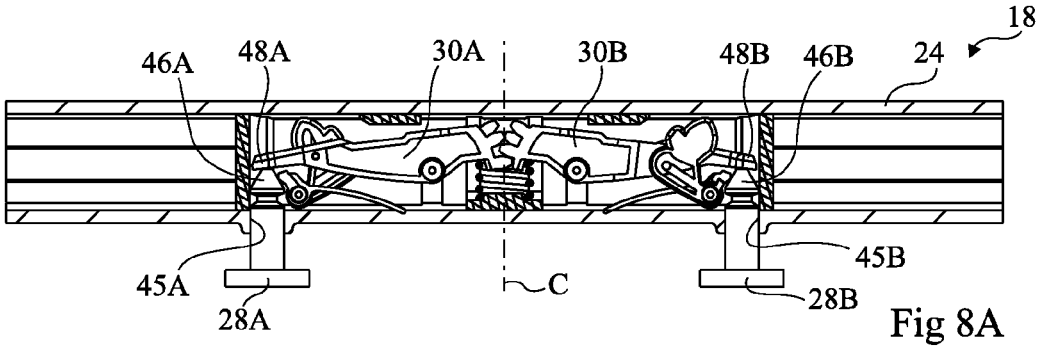
FIGS. 8A to 8D are cross-section views of the embodiment of the fastening device of FIG. 2 at successive steps during an operation of fitting the toilet seat to a toilet bowl.

FIG. 8A shows locking device 18 after the user has introduced end portions 46A, 46B of pins 28A, 28B into openings 45A, 45B of tube 24 and has started bringing tube 24 closer to the seating portion by displacing it downwards along direction C. This may be obtained by exerting a downward pressure on the front part of the seat and of the lid, in vertical position, along direction C. FIG. 8A shows the time when end portions 46A, 46B of pins 28A, 28B come into contact with ends 48A, 48B of arms 30A, 30B.

Figure 8B:
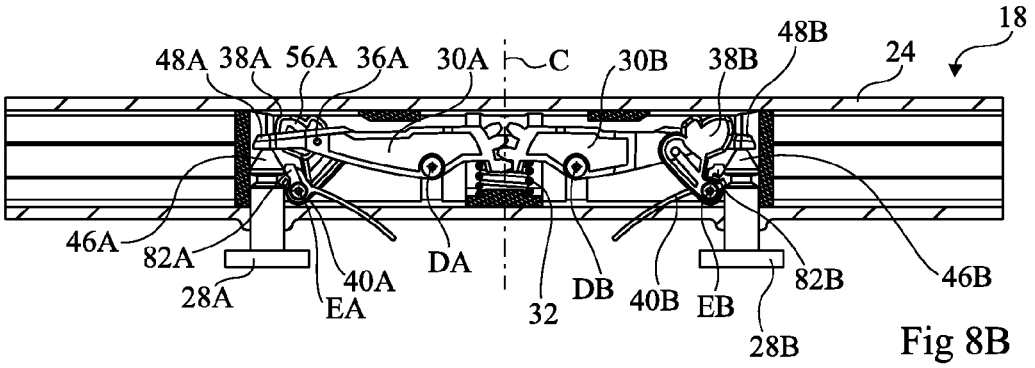

FIG. 8B shows locking device 18 after the user has, with respect to the position shown in FIG. 8A, continued bringing tube 24 closer to the seating portion by displacing it downwards along direction C. When tube 24 is brought closer to the seating portion, pins 28A, 28B exert a pressure on ends 48A, 48B of arms 30A, 30B. This causes a pivoting of arms 30A, 30B around axes DA and DB and a compressing of spring 32. Arm 30A pivots clockwise in FIG. 8B. Finger 36A displaces in groove 56A of cam 38A from limiting lower position 62A to first limiting lower position 64A. This translates in FIG. 8B as a counterclockwise pivoting of cam 38A around axis EA. The sliding of head 82A on end portion 46A of pin 28A causes a clockwise pivoting of locking part 40A around axis EA in FIG. 8B. The pivoting of locking part 40A causes the deformation of flexible tab 86A against tube 24. For simplification, in FIGS. 8B, 8C, and 8D, deformed flexible tabs 86A, 86B are shown as crossing tube 24.

Figure 8C:
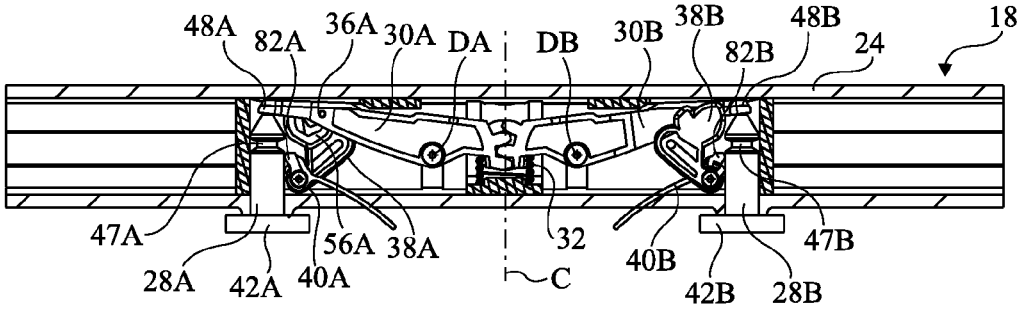

FIG. 8C shows locking device 18 after the user has, with respect to the locked position shown in FIG. 8B, continued bringing tube 24 closer to the seating portion by displacing it downwards along direction C, tube 24 substantially coming into contact with bases 42A, 42B of pins 28A, 28B. During the relative displacement between pin 28A and locking part 40A, head 82A penetrates into groove 47A, comes out of groove 47A, and then continues sliding along cylindrical body 44A of pin 28A. Further, under the action of pin 28A on end 48A of arm 30A, arm 30A has pivoted clockwise around axis DA in FIG. 8C, further compressing spring 32. Finger 36A displaces in groove 56A of cam 38A all the way to the second limiting upper position 66A. This causes a clockwise pivoting of cam 38A.

As a variation, the shape of groove 56A may be adapted so that cam 38A is in a position which enables to prevent head 82A of locking part 40A from penetrating into groove 47A of pin 28A, due to the pressing of pin 74A, 74B of cam 38A, 38B against stop 84A, 84B of locking part 40A, 40B, during the relative displacement of pin 28A relative to tube 24.

Figure 8D:
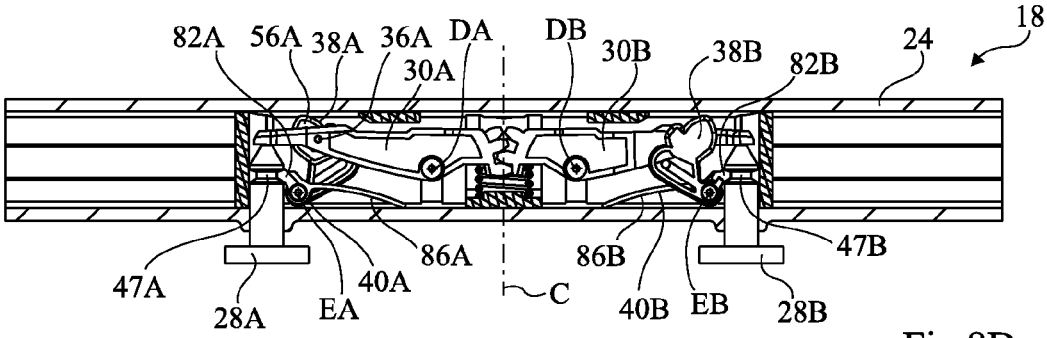

FIG. 8D shows locking device 18 after the user has, with respect to the position shown in FIG. 8C, started taking tube 24 away from the seating portion by displacing it upwards along direction C. This may be obtained by exerting a traction on the front part of the seat and of the lid, in vertical position, upwards along direction C. Under the action of spring 32, arm 30A has pivoted around axis DA in the counterclockwise direction in FIG. 8D. Finger 36A displaces in groove 56A of cam 38A from second limiting upper position 66A to locking position 68A. This translates in FIG. 8D as a clockwise pivoting of cam 38A around axis EA. Under the action of flexible tab 86A, a counterclockwise pivoting of locking part 40A around axis EA is obtained, which makes head 82A penetrate into groove 47A of pin 28A, pin 74A allowing the pivoting of locking part 40A. Fastening device 18 is then locked on pins 28A, 28B. As a variation, the action of spring 32 may be such that the user does not have to or only slightly has to pull on the toilet seat.

During a removal or fitting operation, convex portion 78A, 78B of flexible tab 76A, 76B of each cam 38A, 38B continuously rubs against support 29. Thereby, each cam 38A, 38B remains substantially motionless and does not tilt under its own weight, for example, when finger 36A supported by each arm 30A, 30B is in limiting lower position 62A.

Specific embodiments have been described. Various alterations, modifications, and improvements will readily occur to those skilled in the art. In particular, flexible tabs 86A, 86B may be replaced with helical springs.

The invention claimed is:

1. A device for fastening a toilet seat to a first element fastened to a toilet bowl, the device comprising:

a housing configured to be moved along the first element toward and away from the toilet bowl; and a first locking part movably supported by the housing;

wherein, for each back and forth motion of the housing relative to the toilet bowl, the first locking part is moved between a first position, where the first locking part cooperates with the first element to secure the device to the toilet bowl, and a second position, where the first locking part disengages the first element to release the device from the toilet bowl.

2. The device of claim 1, further comprising:

a support fastened to the housing;

a spring positioned within the housing;

a first arm hinged with respect to the support and stressed at a first end by the spring and configured to be stressed by the first element at a second end; and a first cam cooperating with the first arm and hinged with respect to the support, the first cam pivoting the first locking part relative to the support during each back and forth motion of the housing relative to the toilet bowl.

3. The device of claim 2, wherein the first arm is hinged with respect to the support around a first axis, and wherein the first cam and the first locking part are hinged with respect to the support around a second axis different from the first axis.

4. The device of claim 2, wherein the first cam comprises a first groove following a first closed curve.

5. The device of claim 4, wherein the first arm includes a first finger extending into the first groove.

6. The device of claim 4, wherein the second axis is located outside of the first closed curve.

7. The device of claim 2, wherein the first locking part comprises a first flexible tab configured to pivot the first locking part against the first element.

8. The device of claim 2, further comprising:

a second locking part movably supported by the housing, wherein for each back and forth motion of the housing relative to the toilet bowl, the second locking part is moved between a first position, where the second locking part cooperates with a second element fastened to the toilet bowl to secure the device to the toilet bowl, and a second position, where the second locking part disengages the second element to release the device from the toilet bowl;

a second arm hinged with respect to the support and stressed at a third end by the spring and configured to be stressed by the second element of the toilet bowl at a fourth end; and a second cam cooperating with the second arm and hinged with respect to the support, the second cam pivoting the second locking part relative to the support during each back and forth motion of the fastening device relative to the toilet bowl.

9. The device of claim 8, wherein the first arm comprises a first toothed portion adjacent the first end, wherein the second arm comprises a second toothed portion adjacent the third end, and wherein the first toothed portion meshes with the second toothed portion.

10. The device of claim 8, wherein the second arm is hinged with respect to the support around a third axis, and wherein the second cam and the second locking part are hinged with respect to the support around a fourth axis different from the third axis.

11. The device of claim 8, wherein the first cam comprises a first groove following a first closed curve, and wherein the second cam comprises a second groove following a second closed curve.

12. The device of claim 11, wherein the first arm includes a first finger extending into the first groove, and wherein the second arm includes a second finger extending into the second groove.

13. The device of claim 11, wherein the fourth axis is outside of the second curve.

14. The device of claim 8, wherein the first locking part comprises a first flexible tab configured to pivot the first locking part against the first element, and wherein the second locking part comprises a second flexible tab configured to pivot the second locking part against the second element.

15. A toilet comprising:

a bowl having a first element fastened thereto;

a toilet seat; and the device of claim 1 for fastening the toilet seat to the first element of the bowl.

16. The device of claim 1, wherein the first element defines a first groove, wherein in the first position, the first locking part is configured to be at least partially received in the first groove, and wherein in the second position, the first locking part is not received in the first groove.

* * * * *